United States Patent [19]

Kasahara

[11] Patent Number: 4,864,358

[45] Date of Patent: Sep. 5, 1989

[54] COLOR IMAGE FORMING APPARATUS

[75] Inventor: Nobuo Kasahara, Yokohama, Japan

[73] Assignee: Ricoh Company, Ltd., Tokyo, Japan

[21] Appl. No.: 164,132

[22] Filed: Mar. 4, 1988

[30] Foreign Application Priority Data

Mar. 4, 1987 [JP] Japan ..... 62-49179

[51] Int. Cl.[4] ..... G03G 15/00; G03G 15/14

[52] U.S. Cl. ..... 355/277; 355/315

[58] Field of Search ..... 355/3 R, 3 TR, 3 SH, 355/14 TR, 16, 14 SH, 3 DR

[56] References Cited

U.S. PATENT DOCUMENTS

| | | | |
|---|---|---|---|
| 4,338,017 | 7/1982 | Nishikawa | 355/3 TR |
| 4,370,051 | 1/1983 | Matsuyama et al. | 355/3 R |
| 4,411,511 | 10/1983 | Ariyama et al. | 355/3 TR |
| 4,740,813 | 4/1988 | Roy | 355/3 DR |
| 4,748,473 | 5/1988 | Tsuruoka | 355/14 SH |
| 4,751,547 | 6/1988 | Fratangelo | 355/3 SH |

*Primary Examiner*—A. C. Prescott

*Attorney, Agent, or Firm*—Oblon, Spivak, McClelland, Maier & Neustadt

[57] ABSTRACT

A color image forming apparatus having optics for scanning, photoconductive means and transfer means which are driven independently of each other, repetitively scanning a color original document by the optics to sequentially form latent images associated with the document on the photoconductive means which is rotating, developing each of the latent images by color toner when it is formed, sequentially transferring the resulting toner images to a paper sheet which is held on the transfer means which is rotated in contact with the photoconductive means in a predetermined transfer region, separating the paper sheet from the transfer means after the transfer by separator means which is located near the transfer means, and transporting the paper sheet separated from the transfer means to fixing means to complete a color copy. The separator means is located such that the distance between the transfer region and the separator means is shorter than a dimension of a paper sheet of the smallest size usable with the apparatus as measured in an intended direction of paper transfer. The distance between the separator means and the fixing means is longer than a dimension of a paper sheet of the largest size usable with the apparatus as measured in the intended direction of paper sheet.

8 Claims, 10 Drawing Sheets

Fig, 8

| |
|---|
| Fig. 8A |
| Fig. 8B |

COLOR IMAGE FORMING APPARATUS

BACKGROUND OF THE INVENTION

The present invention relates to an image forming apparatus which enhances stable transfer of an image to a paper sheet and reliable transport of the paper sheet in the event that transfer means is accelerated relative to photoconductive means to reduce a copying time.

A color electrohotographic copier of the type having optics for scanning, photoconductive means, and transfer means is known in the art. In this type of copier, the optics repetitively scans a color original document to sequentially form latent images associated with the document on the photoconductive means which is rotating. The latent images are each developed by color toner, and the resulting toner images are sequentially transferred to a paper sheet which is loaded on the transfer means which is rotating in contact with the photoconductive means in a predetermined transfer region. The paper sheet undergone such image transfer is separated from the transfer means by separator means which is positioned near the transfer means. Finally, the paper sheet is fed to fixing means to complete a color copy. It has been customary to implement the photoconductive means with a photoconductive drum and the transfer means with a transfer drum. The photoconductive drum is sequentially exposed to a plurality of separated color components by the optics, whereby electrostatic latent images each being associated with a respective one of the color components are provided on the photoconductive drum. The latent images are each developed by toner of a particular color which is complementary to the latent image, and the resulting toner images are sequentially transferred to a paper sheet which is retained on the transfer drum.

A prerequisite with the above-described type of color copier is that the copier be free from the deviation of color components on a paper sheet which is detrimental to the quality of reproduction. This requirement is generally met by designing the circumferential dimension of one of the photoconductive and transfer drums to be an integral multiple of that of the other and interconnecting the two drums by gears or the like which encounter a minimum of backlash to drive them together at a constant speed. Such a drive system, however, causes the transfer drum to simply follow the rotation of the photoconductive drum and therefore rotate at a constant speed with no regard to the size of a paper sheet, resulting in the copying time being constant with no regard to the same. That is, it does not contemplate increasing the rotation speed of the transfer drum relative to that of the photoconductive drum after the trailing edge of a paper sheet of comparatively small size has moved away from the transfer region and thereby reducing the copying time.

One approach heretofore proposed to reduce the copying time is driving the transfer and photoconductive drums by individual drive sources and providing positioning disks on opposite sides of the photoconductive drum such that the disks are free to rotate on a common axis. The positioning disks receive a transfer pressure developed between the two drums so that the transfer drum alone may be accelerated during the transfer of a toner image to a paper sheet of comparatively small size. With this scheme, since the rotation speed of the transfer drum is variable independently of the photoconductive drum, it is theoretically possible to accelerate the transfer drum during the interval between the movement of the trailing edge of a paper sheet away from the transfer region and the arrival of the leading edge of the same sheet at the transfer region to thereby make the copying time as short as possible.

A problem with the above-described scheme is as follows. A prerequisite with color copying is that a paper sheet undergone the last one of a sequence of transfer cycles be guided by a separator pawl, a kind of separator means, after its leading edge has been released from a sheet gripper. Assume that the transfer drum is accelerated simply by sensing that the trailing edge of a paper sheet has moved away from the transfer region, and that the paper sheet is of comparatively small size. Then, since the leading edge of the paper sheet has not reached the separator pawl yet, various troubles such as damage to non-fixed toner images and a jam are apt to occur due to substantial resistance ascribable to separation which occurs when the leading edge of the paper sheet moves away from the separator pawl.

SUMMARY OF THE INVENTION

It is, therefore, an object of the present invention to provide a color image forming apparatus which reduces copying time.

It is another object of the present invention to provide a color image forming apparatus which eliminates damage to non-fixed toner images on a paper sheet, jam and other troubles when a transfer drum is accelerated relative to a photoconductive drum with the intention of reducing copying time.

It is another object of the present invention to provide a color image forming apparatus which prevents the leading edge of a paper sheet from being transported in an unstable condition due to the resistance of a separator pawl when a transfer drum is accelerated relative to a photoconductive drum as stated above.

It is another object of the present invention to provide a generally improved color image forming apparatus.

An image forming apparatus of the present invention comprises photoconductive means for forming an electrostatic latent image thereon, transfer means for transferring in a predetermined transfer region a visible image which has been produced by developing the latent image to a paper sheet which is held on the transfer means, separator means arranged along periphery of the transfer means for separating from the transfer means the paper sheet to which the visible image has been transferred, and drive means for independently driving the photoconductive means and the transfer means. The separator means is spaced apart from the transfer region along the periphery of the transfer means by a distance which is shorter than a dimension of a paper sheet having the smallest size usable with the apparatus as measured in an intended direction of paper transport.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
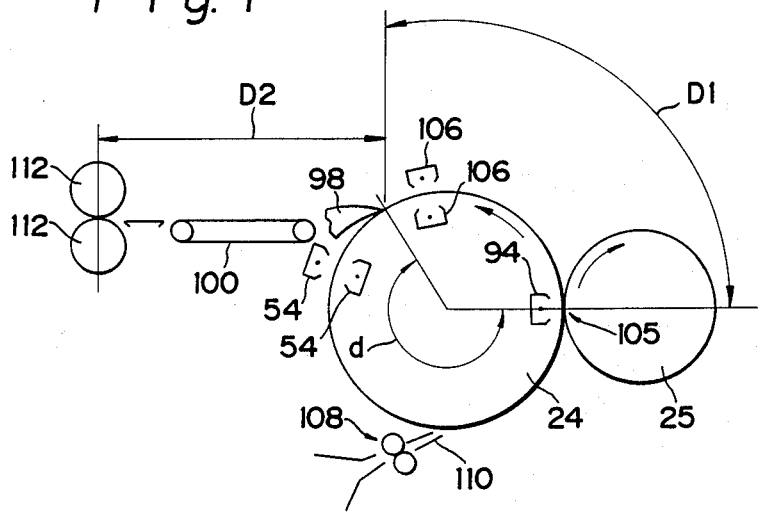
FIG. 1 is a schematic elevation showing the arrangement of a transfer drum, a separator pawl, a fixing roller and others which are included in a color image forming apparatus embodying the present invention.
Figure 2:
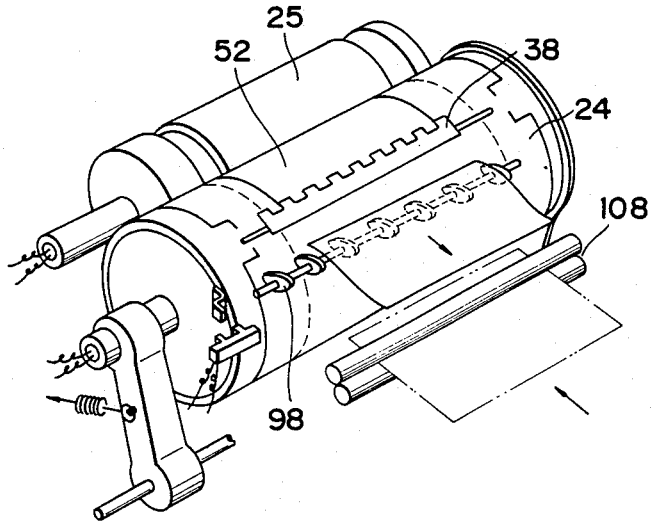
FIGS. 2 and 3 are perspective views each showing the transfer drum together with a photoconductive drum and others which are included in the same apparatus.

Referring to FIG. 1 of the drawings, there are shown a transfer drum 24 and a photoconductive drum 25 which are examples of transfer means and photoconductive means, respectively. A transfer region 105 is defined by that part of the surface of the transfer drum 25 which faces the photoconductive drum 25. A transfer charger 94 is disposed in the transfer drum 24 to span the transfer region 105. A separation charger 106 is located downstream of the transfer region 105 with respect to an intended direction of rotation of the transfer drum 24 which is indicated by an arrow in the figure. Disposed downstream of the separation charger 106 is a separator pawl 98 which constitutes a part of separator means. As shown in FIG. 2, the separator pawl 98 in practice comprises a number of pawls which are mounted on a shaft which is parallel to the shaft of the transfer drum 24 and are located at equally spaced locations along that shaft, the tips of the pawls being usually spaced from the drum surface by a predetermined distance. Further, a sheet gripper 38 is provided for gripping the leading edge of a paper sheet 52. To release the paper sheet 52, the sheet gripper 38 is rotated by a cam mechanism which is mounted on the end of the shaft before it reaches the separator pawl 98. The leading edge of the paper sheet 52 released from the sheet gripper 98 gets on the pawl 98 due to its own elasticity, so that the paper sheet 52 is sequentially separated from the drum 24 by the rotation of the drum 24.

Referring again to FIG. 1, the paper sheet 52 separated from the drum 24 is transported by a belt 100 to a fixing roller pair 112. A discharger 54 is located adjacent to the transfer drum 24 and downstream of the separator pawl 98. Situated downstream of the discharger 54 and immediately below the transfer drum 24 are a register roller pair 108, a guide 110 and others which serve to drive the paper sheet 52 toward the transfer drum 24.

In the above construction, assume that the distance between the transfer region 105 and the tip of the separator pawl 98 as measured along the circumference of the transfer drum 24 is $D_1$, and that the smallest one of various paper sizes which are usable with the image forming apparatus has a dimension of $D_{min}$ as measured in an intended direction of paper transport. Then, the separator pawl 98 is located at a position where a relationship of $D_1 > D_{min}$ holds. This allows the transfer drum 24 to be accelerated by extremely simple control which is triggered only by the movement of the trailing edge of the paper sheet 52 away from the transfer region 105, without entailing troubles such as a jam at the separator pawl 98. Specifically, when the leading edge of the paper sheet 52 is to be separated by the separator pawl 98, the trailing edge of the same is still located in the transfer region 105 and firmly pressed against the transfer drum 24 to push the paper sheet 52 from behind. This, coupled with that fact that the transfer drum 24 is not accelerated yet, promotes smooth separation of the leading edge of the paper sheet 52.

Even when the sequential transfer of toner images to the single paper sheet 52 is under way, the transfer drum 25 can be accelerated immediately after the trailing edge of the paper sheet 52 has moved past the transfer region 105. The result is a decrease in the loss of time and therefore rapid copying operation. Of course, the transfer drum 25 is controlled to a usual rotation speed, i.e., decelerated immediately before the leading edge of the paper sheet 52 reaches the transfer region 105.

In the above construction, when the leading edge of the paper sheet 52 is to be separated from the transfer drum 25 after the last one of a sequence of transfer cycles, the trailing edge thereof is located in the transfer region 105 without fail. This eliminates the troubles otherwise caused in the event of separation, as previously stated. To reduce the copying time, the transfer drum 24 is accelerated at the instant when the trailing edge of the paper sheet 52 has moved away from the transfer region 105, preferably after it has moved away from the separator pawl 98. The acceleration of the transfer drum 24 can be started when the trailing edge of the paper sheet 52 moves away from the transfer region 105, preferably when it moves away from the separator pawl 98, and the acceleration can be ended immediately before the leading edge of the paper sheet 52 reaches the transfer region 105. It follows that, considering the preferable conditions stated above, the transfer drum 24 may be accelerated and decelerated in a range which is indicated by d in FIG. 1. Further, when the drum 24 is accelerated immediately after the trailing edge of the paper sheet 52 has moved away from the transfer region 105, the leading edge of the paper sheet 52 has already been separated from the drum 24. Hence, the paper sheet 52 will be successfully transported toward the fixing roller pair 112 without interfering with the belt 100 only if the velocity of the belt 100 is selected to be higher than the linear velocity of the transfer drum 24.

The separator pawl 98 and the fixing roller pair 112 are positioned relative to each other as follows. It is necessary that the distance $D_2$ between the separator pawl 98 and the fixing roller pair 112 be greater than the largest one of various paper sizes usable with the apparatus. This is to eliminate an occurrence that, when the leading edge of the paper sheet 52 is caught by the fixing roller 112 and, therefore, the transport becomes unstable due to the resistance, the trailing edge of the same still remains on the separator pawl 98 to render the transport of the paper sheet 52 unstable. Such unstable transport would cause non-fixed toner images to be blurred on the paper sheet 52 and would cause the paper sheet 52 itself to be twisted. If the distance between the separator pawl 98 and the fixing roller pair 112 is selected to be greater than the dimension of the largest one of paper sizes as measured in the direction of paper transport, whenever the leading edge of a paper sheet is caught by the fixing roller 112, the training edge of the same is away from the separator pawl 98 and in a free state with no regard to the paper size. This contributes a great deal to reliable transport of a paper sheet. It follows that if the position of the separator pawl 98 relative to the transfer region 105 and that of the fixing roller pair 112 relative to the separator pawl 98 are individually matched to the above-stated conditions, reliable paper transfer is promoted to prevent toner images from being blurred, deviated and otherwise effected while, at the same time, the copying time is reduced.

Hereinafter will be described a configuration of the photoconductive drum and a mechanism for driving the transfer drum independently of the photoconductive drum which are desirable for practicing the present invention, together with a an exemplary color copier which uses them.

Figure 3:
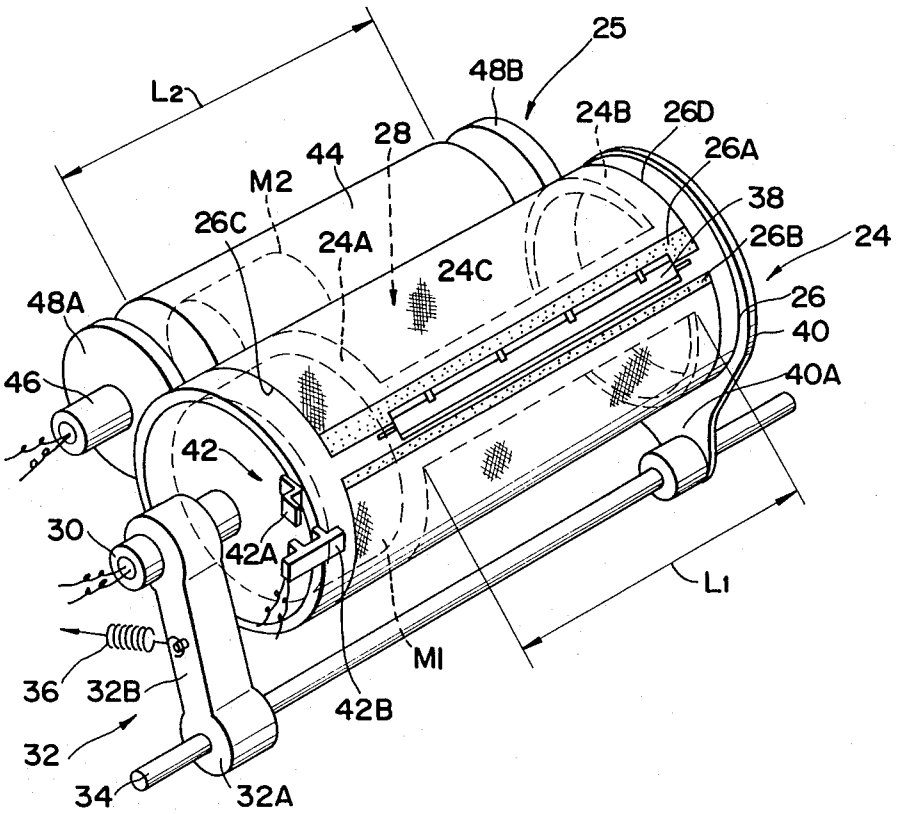
Figure 4:
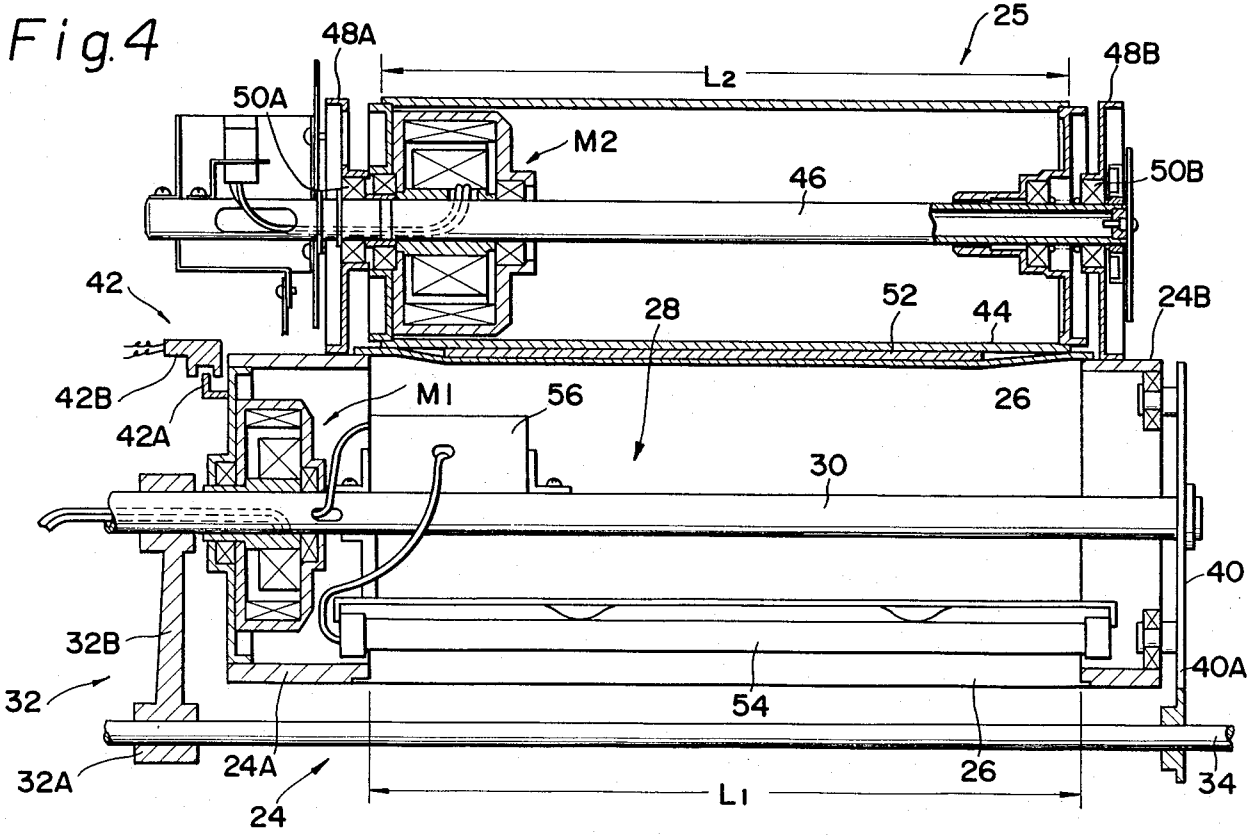
FIGS. 4 and 5 are sections each showing a relationship between the photoconductive drum and the transfer drum.

Referring to FIGS. 3 and 4, there are shown a transfer drum, or exemplary transfer means, 24 and a photoconductive drum, or exemplary photoconductive means, 25. The transfer drum 24 which has a hollow cylindrical frame-like configuration is constituted by two rings 24A and 24B which are located coaxially with and at spaced locations from each other, and a connecting portion 24C which extends parallel to the axis of the drum 24 to interconnect the rings 24A and 24B. A dielectric sheet 26 is implemented with a flexible member and wrapped around the transfer drum 24 by using the circumferential surfaces of the rings 24A and 24B. Opposite ends 26A and 26B only of the dielectric sheet 26 are individually fixed to the connecting portions 24C by adhesive, hooks or similar suitable fixing means. Opposite side edges 26C and 26D of the dielectric sheet 26 are not fixed to the rings 24A and 24B, defining an intermediate opening 28 therein. The dimensions of the intermediate opening 28 as measured in the axial direction of the transfer drum 24 is $L_1$. The transfer drum 24 is supported by a hollow shaft 30. An outer rotor type motor $M_1$ is disposed in the transfer drum 24 to drive the outer peripheral portion of the drum 24 with a rotary motion relative to the shaft 30. One end of the shaft 30 is rotatably connected to one end of an arm 32, the other end of which is in turn rotatably connected to a stationary shaft 34. A tension spring 36 is anchored to an intermediate portion 32B of the arm 32 so that a predetermined transfer pressure is applied from the transfer drum 24 to the photoconductive drum 25. The sheet gripper 38 for gripping the leading edge of a paper sheet is provided on the connecting portion 24C of the transfer drum 24. The other end of the shaft 30 is fixedly connected to a face plate 40 while the outer peripheral portion of the transfer drum 24 is journalled to the face plate (see FIG. 4). A base portion 40A of the face plate 40 is rotatably connected to the stationary shaft 34. A member 42A to be sensed is fixed to one end portion of the transfer drum 24 while a sensor 42B is fixed to an unmovable member, not shown, and located in a path along which the member 42A is movable. Constituted by a light emitting element and a light-sensitive element, for example, the sensor 42B cooperates with the member 42A to constitute a home position sensor for sensing a home position of the transfer drum 24.

The photoconductive drum 25 which is a rigid member includes a photoconductive material 44 which is wrapped around the drum 26. The drum 25 itself is rotatably mounted on a hollow stationary shaft 46. An outer rotor type motor M2 is disposed in the drum 25 to drive the latter with a rotary motion. Labeled $L_2$ is the width of the photoconductive drum 25, more particularly the width of the photoconductive material 44. In the illustrative embodiment, the width $L_2$ of the photoconductive drum 25 is smaller than that $L_1$ of the intermediate opening 28 of the transfer drum 24.

Positioning disks 48A and 48B each in the form of a rotatable ring are positioned at axially opposite end portions of the photoconductive drum 25 and are rotatable relative to the shaft 46 through bearings 50A and 50B, respectively (FIG. 4). The positioning disks 48A and 48B are respectively pressed against those potions of the rings 24A and 24B of the transfer drum 24 in which the dielectric sheet 26 is absent, whereby the drums 24 and 25 are spaced apart from each other by a predetermined distance which allows the dielectric sheet 26 and the photoconductive material 44 to make light contact with each other.

In the above construction, a transfer pressure is developed between the transfer drum 24 and the photoconductive drum 25 by way of the positioning disks 48A and 48B which are free to rotate relative to the shaft 46. This, coupled with the fact that the width $L_2$ of the photoconductive material 44 is smaller than that $L_1$ of the intermediate opening 28 of the transfer drum 24, causes the photoconductive material 44 and the dielectric sheet 26 to slip smoothly on each other even when the rotation speed of the drum 24 is changed relative to that of the drum 25. Hence, the image reproduction is free from blurring, jitter and other undesirable occurrences. Since the positioning disks 48A and 48B are pressed against the transfer drum 24 while avoiding the dielectric sheet 26, the dielectric sheet 26 is prevented from being deformed or rolled even after a long period of use, insuring reliability of operation as well as durability. Furthermore, the dimensional accuracy required for the framework of the transfer drum 24 and therefore the cost is cut down as compared to the conventional design.

In this particular embodiment, a paper sheet 52 is positioned between the photoconductive material 44 and the dielectric sheet 26 which yields into the intermediate opening 28. This promotes uniform transfer of a toner image and increases the transfer efficiency. Implemented with a flexible film of polyester, 4-vinylidene fluoride or like material, the dielectric sheet 26 is capable of uniformly pressing on even relatively thin paper sheets due to its elasticity, thereby insuring image transfer. Since the photoconductive material 44 is not directly pressed by the transfer drum 24 and since the dielectric sheet 26 is not directly pressed by the disks 48A and 48B, there is eliminated the deposition of toner, paper dust and other particles which would otherwise damage the materials 44 and 46 and/or affect the image transfer.

In FIG. 4, the discharger 54 is powered by a power pack 56 that is mounted on the shaft 30. The hollow shafts 30 and 46 are individually used to accommodate the leads adapted for the drive of the motors M1 and M2 therein.

Figure 5:
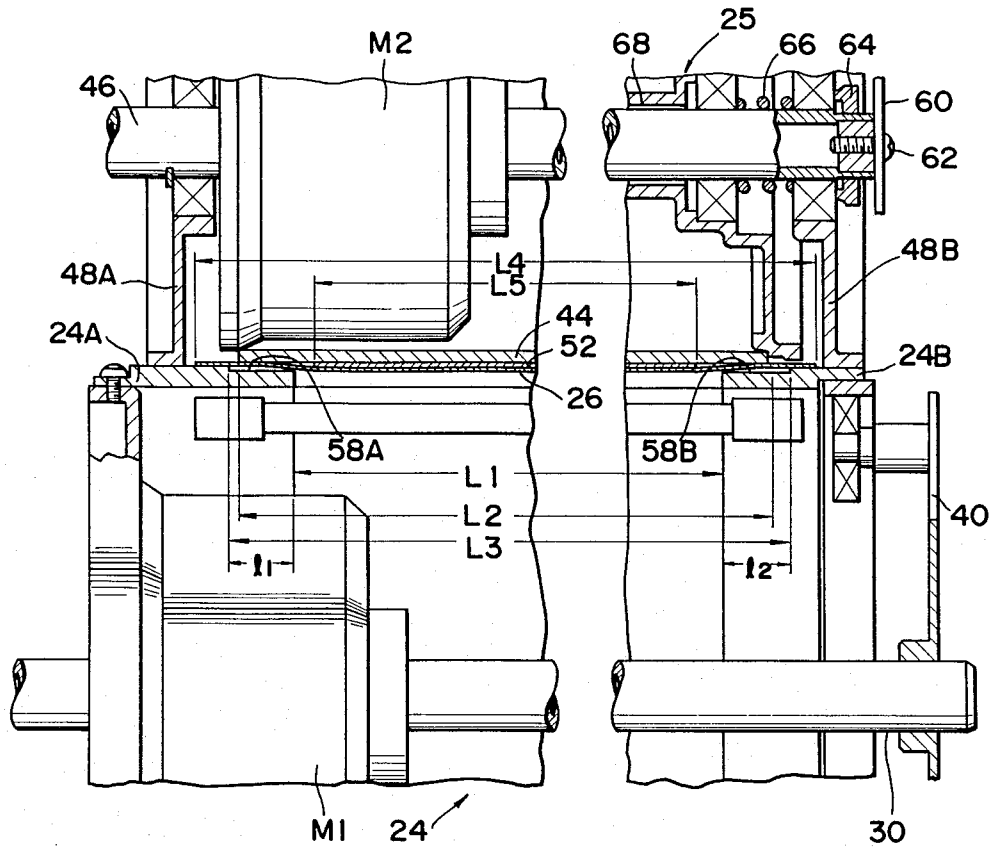

Referring to FIG. 5, a modification to the above-described embodiment is shown in a fragmentary enlarged view. As shown, the rings 24A and 24B of the transfer drum 24 are provided with, respectively, stepped portions 58A and 58B, each allowing the dielectric sheet 26 to yield thereinto. The sum of the widthwise dimension $L_1$ of the intermediate opening 28 and dimensions $l_1$ and $l_2$ of the stepped portions 58A and 58B, respectively, is assumed to be $L_3$. In this case, the total dimension including those of the stepped portions 58A and 58B is the width of the transfer means and substantially constitutes a region into which the dielectric sheet 26 can yield. Hence, the width $L_2$ of the photoconductive drum 25 does not have to be smaller than that $L_1$ of the intermediate opening 28, i.e., the width $L_2$ need only be smaller than the dimension $L_3$ which includes the stepped portions 58A and 58B. In this modification, the width $L_4$ of the dielectric sheet 26 is smaller than the distance between the positioning disks 48A and 48B and, therefore, the disks 48A and 48B are not pressed against the dielectric sheet 26. The dimension of the paper sheet 52 is indicated by $L_5$ and is smaller than the dimension $L_1$ of the intermediate opening 28.

As stated above, in the embodiment and modification thereto, exclusive drive sources, i.e., motors M1 and M2 are assigned to the transfer drum 24 and the photoconductive drum 25, respectively. For this reason and since the drums 24 and 25 are regulated by the positioning disks 48A and 48B which are free to rotate, the drums 24 and 25 are controllable in rotation independently of each other. Therefore, the degradation of image quality ascribable to the use of gears as heretofore experienced is eliminated, and the condition that the circumferential dimension of one of the two drums 24 and 25 must be an integral multiple of the other is not necessary and, hence, the copying speed is efficiently increased. This is also true for a case wherein the drums are each replaced with an endless belt. In the embodiment and modification shown and described, the diameter of the photoconductive drum 25 and that of the transfer drum 24 are 120 millimeters and 180 millimeters, respectively.

Figure 6:
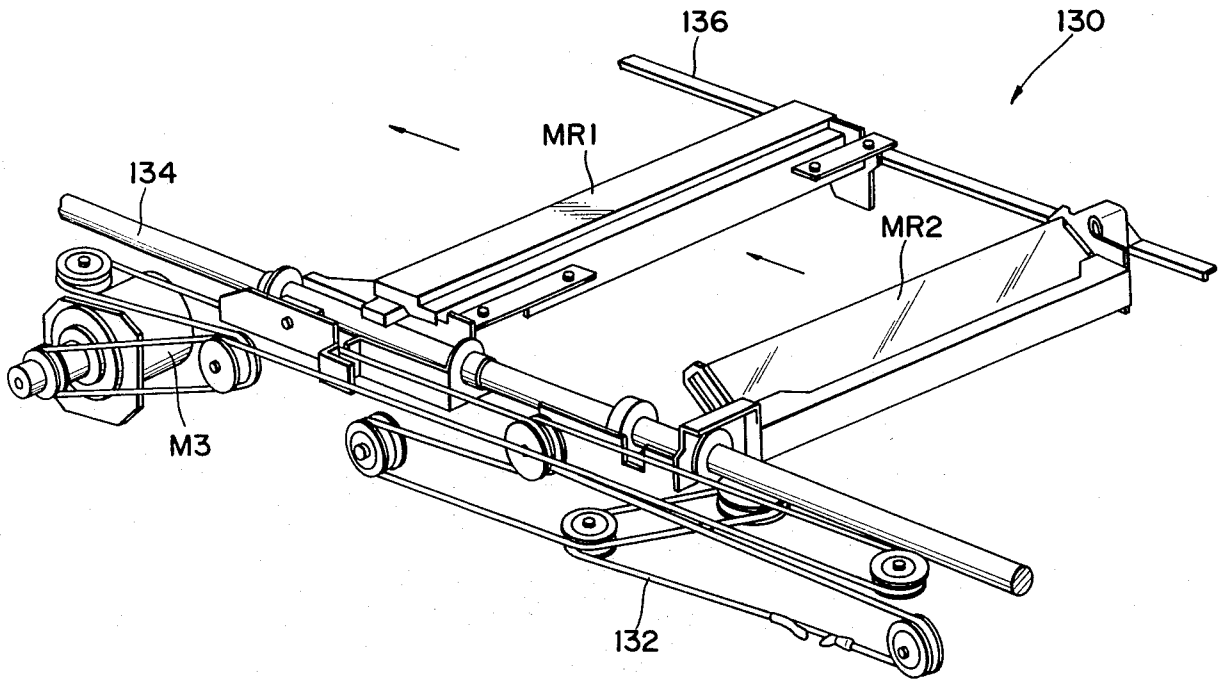
FIG. 6 is a perspective view showing a system for driving optics which is adapted for scanning.

Assume a color copier having a transfer and a photoconductive drum which are driven independently of each other and adopting a superposed transfer system which sequentially transfers a yellow, a magenta, a cyan and, if necessary, a black toner image onto a single paper sheet. In this case, a scanner for illuminating an original document has to be controlled independently also. As shown in FIG. 6, the scanner 130 is driven by a mechanism which includes an exclusive motor M3 and a single scanner wire 132 which is connected to the first and second mirror MR1 and MR2 via a pulley of the motor M3. The motor M3 is implemented with a servo motor (having resolution of about 20 microns per pulse) in which an encoder is built. Guided by guides 134 and 136, the first and second mirrors MR1 and MR2 are moved as indicated by an arrow. The reference position of the scanner 130 is sensed by a scanning sensor 128 (see FIG. 7) which is mounted on a part of the scanner wire 132.

In the case that the scanner 130, photoconductive drum 25 and transfer drum 24 are driven independently of each other in the above-stated manner, toner images have to be transferred to a paper sheet in register with each other by synchronizing them with respect to speed and position. A specific construction of a control section for implementing such synchronization will be described with reference to FIG. 7.

Figure 7:
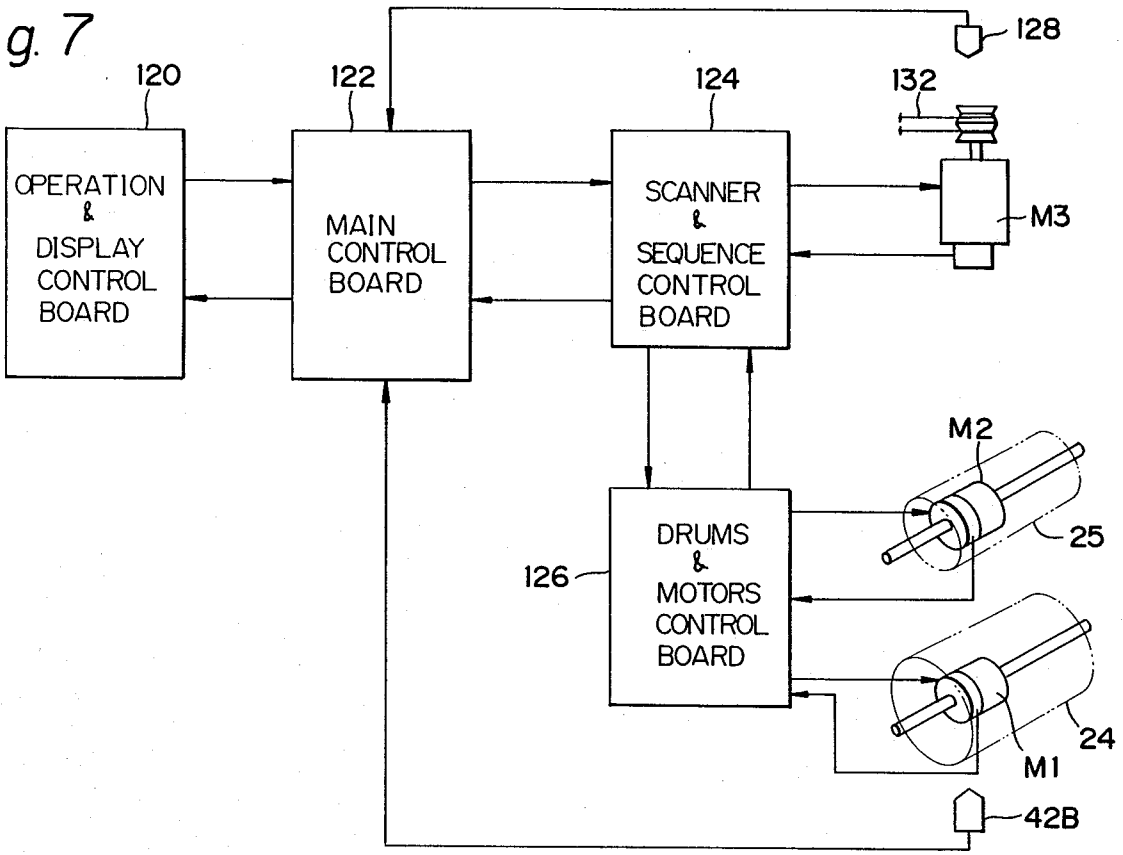
FIG. 7 is a block diagram of a control system.

In FIG. 7, the control section includes an operation and display board 120 which is provided with keys for entering various kinds of commands as well as a data display panel. A main control board 122 is provided for totally controlling the color copier. A board 124 is adapted for the control over the optics and the sequence control while a board 126 is adapted for the control over the motors M1 and M2 which are associated with the transfer drum 24 and 25, respectively. The output of the motor M3 is coupled to the board 124. The output of the motors M1 and M2 are fed to the board 126. Likewise, the output of the sensor 42B is applied to the board 126.

The boards 124 and 126 interchange a drum 24 position command signal, a drum 24 speed command signal, a drum 25 position command signal, a drum 25 speed command signal, a CPU clock pulse signal, and others. The boards 122 and 124 interchange an output of the scanning sensor 128 of the optics 130, a drum 24 reference position signal, an optics 130 scan start signal, a drum 25 speed command signal, a drum 24 reference signal, and others. Further, the boards 122 and 120 interchange a paper 52 size signal, a magnification command signal, a copy mode (multicolor or monocolor) signal, a copy number command signal, and others. Such a control system controls the drums 24 and 25 and optics 130 relative to each other on a real time basis, i.e., it synchronizes them with considerable accuracy.

Figure 8A:
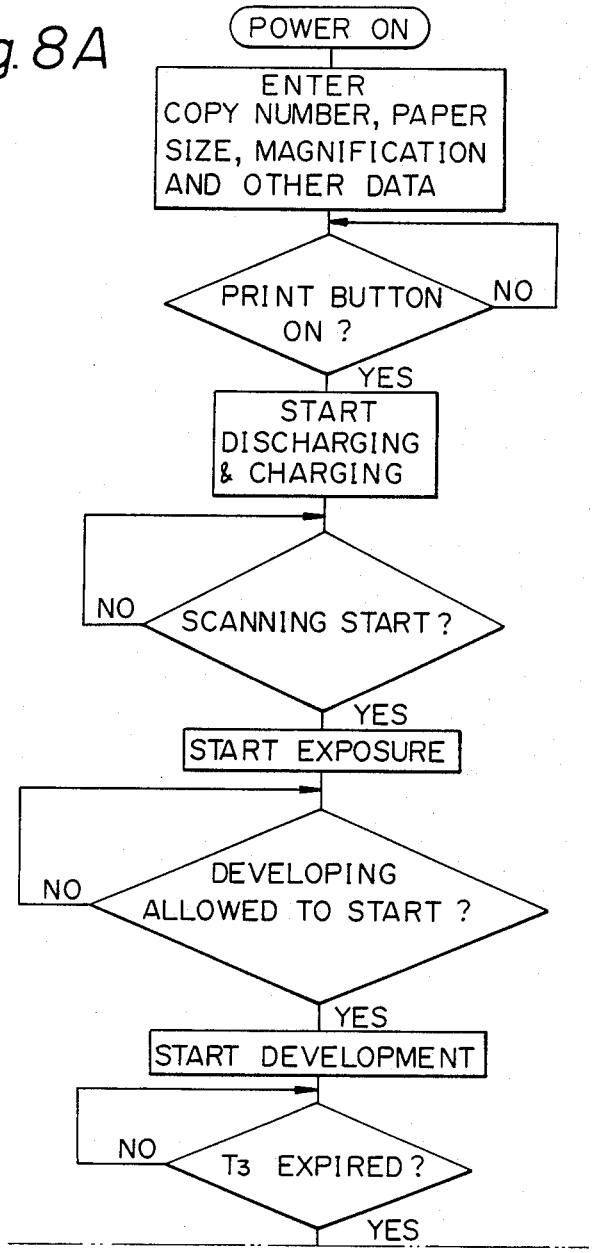
FIGS. 8A and 8B are flowcharts demonstrating a copying process.
Figure 8B:
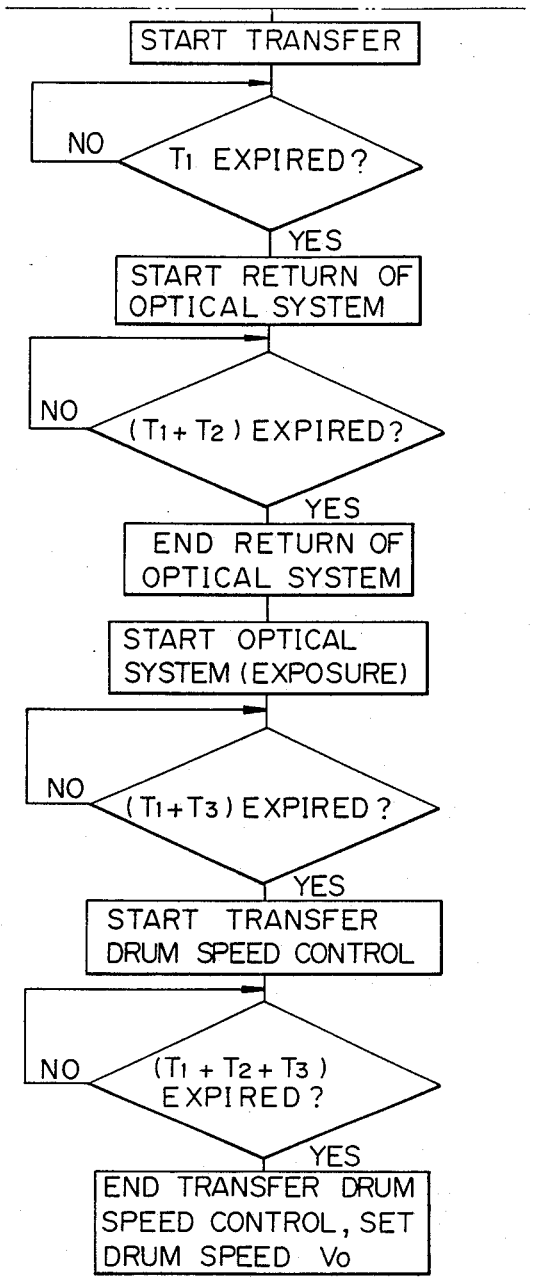
Figure 9:
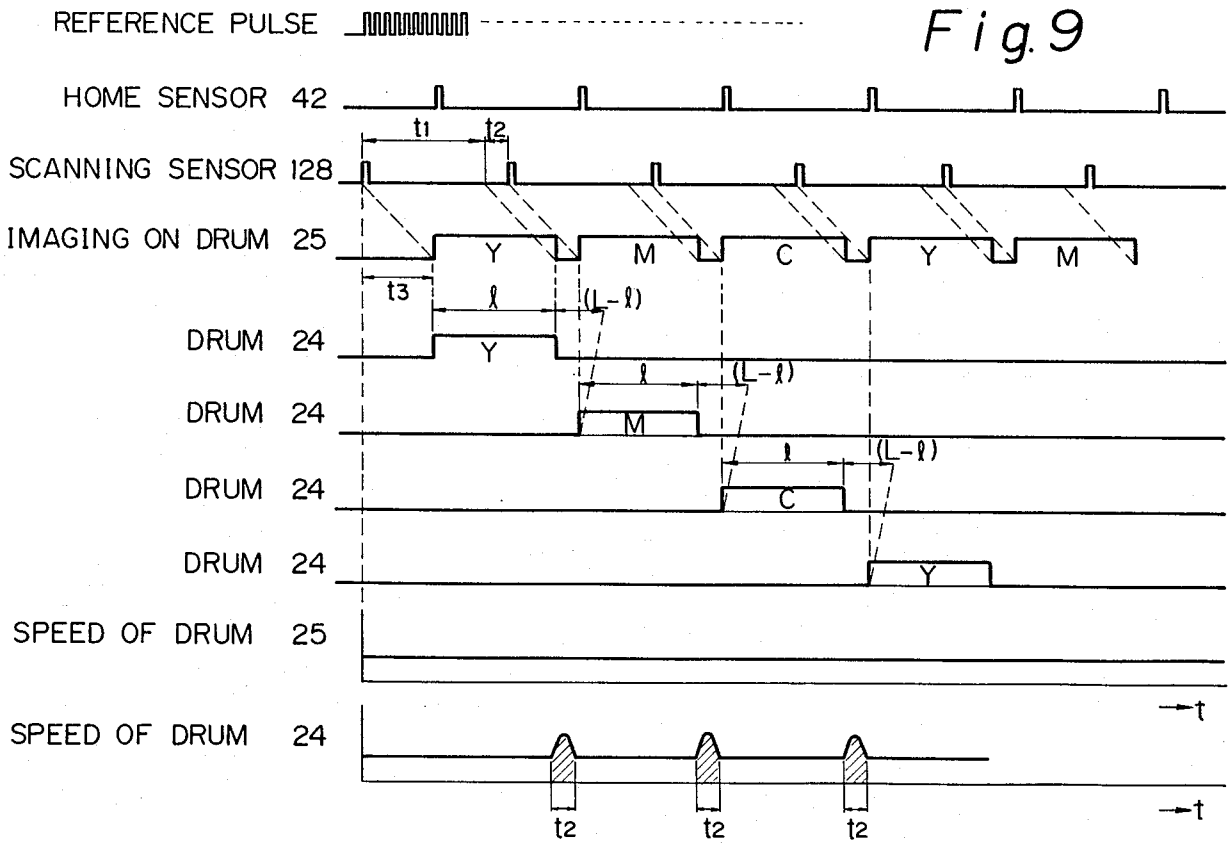
FIG. 9 is a timing chart associated with the flowcharts of FIGS. 8A and 8B.

FIGS. 8A and 8B are flowcharts demonstrating an operation control which is performed in a color copy mode. FIG. 9 is a timing chart showing, in conformity to FIGS. 8A and 8B, a relation between the timings for the images Y, M and C to be formed on the drum 25 and the operation timings of the drum 24, both of which are controlled on the basis of the reference pulses, the output of the home sensor 42 associated with the drum 24 and the output of the scanning sensor 128, as well as a relationship between the drums 24 and 25 in terms of speed. In FIG. 9, L denotes the circumferential dimension of the drum 24, l the length of the paper 52, and R the returning length of the optics 130.

In a color copy mode, various data such as the desired number of copies and the magnification are entered. As a print button of the copier is depressed to start a copying operation, the photoconductive drum 25 is discharged and then charged. When a start timing of the optics 130 is reached, the optics 130 begins to scan a document (this timing is sensed by the scanning sensor 128) so that a latent image representative of a particular color component is electrostatically formed on the drum 25, which is rotating at a constant speed $V_0$. When a developing timing is reached, the latent image is developed by one of developing units which contains toner complementary in color to the latent image. Upon the lapse of a predetermined period of time $t_3$ since the time when the optics 130 has started the scanning, the transfer of the toner image from the drum 25 to the paper sheet 52 on the drum 24 begins. The period of time $t_3$ is adapted for an accurate transfer timing. At this instant, the drum 24 is rotating at the same speed $V_0$ as the drum 25. At the end of the time $t_3$, the drum 24 has assumed its reference position as sensed by the home sensor 130 and the paper 52 on the drum 24 has been aligned at its leading edge with that of the toner image.

Meanwhile, upon the lapse of a period of time $t_1$ (corresponding to a length associated with the document size and the paper size) after the start of the scanning, the scanning is completed so that the servo motor M3 begins to rotat in the opposite direction to return the optics 130. As a period of time $(t_1+t_2)$ expires after the start of the scanning, the return of the optics 130 is completed. Then, the servo motor M3 is driven forward to cause the optics 130 to start another scanning stroke immediately. This allows a latent image representative of the next color component to be formed on the drum 25 without awaiting the completion of one full rotation of the drum 25. At this time, the scanning differs from the previous scanning in that, when the time to complete the transfer is reached after a period of time ($t_1+t_2$), the rotation speed of the drum 24 is variably controlled until the next transfer start timing such that the drum 24 rotates at a higher speed than the drum 25. Specifically, in order to register the image on the drum 25 and the paper sheet 52, estimated reference positions (optics 130 and drum 24) stored in the CPU beforehand and the actually detected positions are compared by the CPU, and the resulting difference is adjusted by correcting the speed of the transfer drum 24. This, as considered on the drum 25, occurs within the returning time $t_2$ of the optics 130, and the paper is moved by the length of (L−l) during that period of time. Upon the lapse of a period of time ($t_1+t_2+t_3$), i.e., when the time to start a transfer is reached, the variable control over the speed of the drum 24 is terminated to drive the drum 24 at the same speed $V_0$ as the drum 25.

The control procedure described above is repeated thereafter.

As shown in FIG. 9, among the various control signals which are based on the reference pulses, the control of the transfer start timing and that of the transfer end timing are performed in response to the output of the home sensor 42 representative of an instantaneous position of the drum 24 and the output of the scanning sensor 130 representative of a scanning start timing. During the interval between the end of one transfer and the start of the next transfer, the rotation speed of the drum 24 is variably controlled to bring the leading edge of the paper 52 into register with that of a toner image. So far as the relation between the speed of the drum 25 and that of the drum 24 as shown in FIG. 9 is concerned, the variable control is such that the drum 24 is moved by the angular distance of (L−l) within the returning time $t_2$ and by an integrated value as indicated by hatching in FIG. 9.

Figure 10:
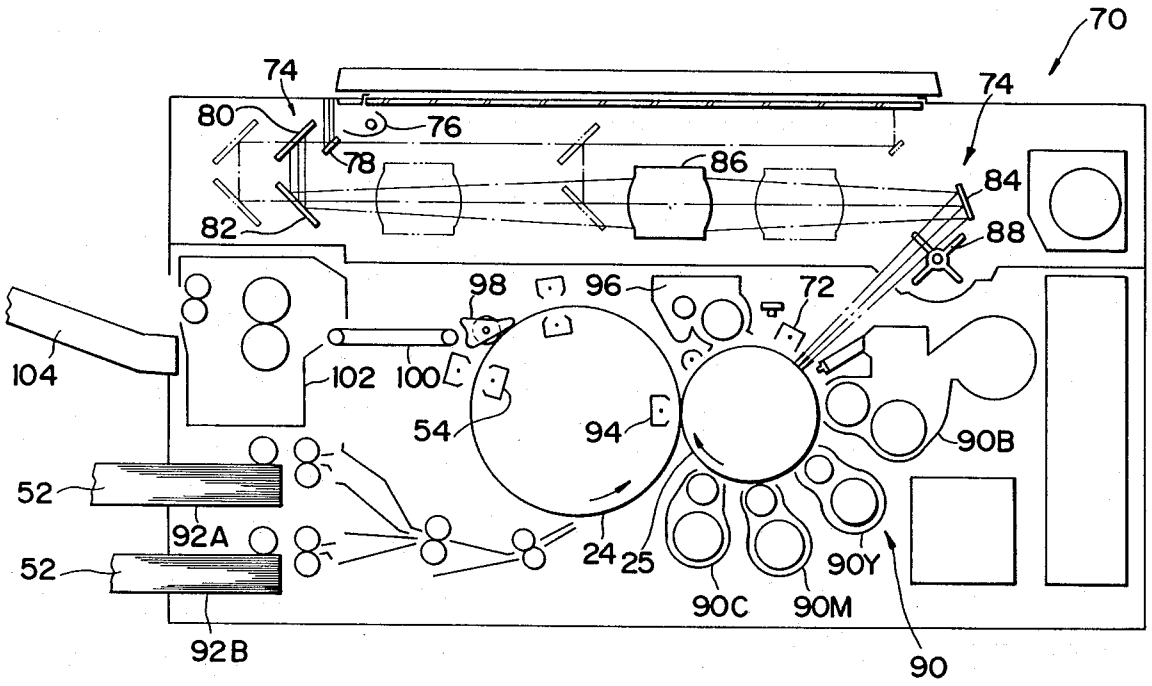
FIG. 10 is a section of a color copier which may advantageously be implemented with the embodiment of the present invention.

Referring to FIG. 10, an exemplary color copier to which any of the embodiment and modification described above are applicable is shown and generally designated by the reference numeral 70. As shown, the copier 70 includes a charger 72 located in the vicinity of a photoconductive drum 25, and scanning optics 74 located next to the charger 72. As well known in the art, the optics 74 includes a lamp 76, a plurality of mirrors 78, 80, 82 and 84, and a lens 86. The optics 74 performs a scanning stroke from a home position indicated by a solid line in the figure to a position which is indicated by a dash-and-dot line in the figure, i.e. over a distance which is associated with the length of a document or magnification selected. From the dash-and-dot line position to the solid line position, the optics 74 performs a return stroke. A color separating filter 88 is disposed in an optical path which is defined by the optics 74. Located next to a position at which a light image is focused by the optics 74 is a developing device 90. The developing device 90 includes a magenta (M) developing unit 90M, a cyan (C) developing unit 90C, and a yellow (Y) developing unit 90Y which are adapted for color copying, and a black (B) developing unit 90B. A hollow transfer drum 24 rotatable with the paper sheet 52 held thereon is disposed after the developing device 90. Specifically, the transfer drum 24 clamps the paper sheet 52 which is fed from any of a plurality of paper cassettes 92A and 92B and carries it for a plurality of cycles of image transfer. Disposed in the hollow transfer drum 24 is a transfer charger 94. The reference numeral 96 designates a cleaning device which is located next to the transfer drum 24.

Basically, the copier 70 having the above construction is operated as follows. The optics 74 repetitively scans a color original document so that the photoconductive drum 25 which is rotating at a predetermined speed is sequentially exposed to a plurality of color components of light. Latent images produced on the drum 25 by such exposure are sequentially developed by the developing device 90 which supplies toner of complementary colors. The resulting toner images are sequentially transferred to the paper sheet 52 which is lamped and rotated by the transfer drum 24, whereby a complete color copy is produced. The paper sheet 52 carrying the composite color copy image thereon is separated from the transfer drum 24 by separator pawl 98, then transported by a belt 100 to a fixing device 102, and then driven to a tray 104.

In the color copier 70, the linear velocity of the drum 25 is changed depending upon a mode which is selected by an operating switch, not shown, i.e. a color mode or a black-and-white mode (or monocolor mode). An experimental model was found operable with a linear speed of 2 in the black-and-white mode for a linear speed of 1 in the color mode, meaning that twice the processing ability is attainable in the black-and-white mode. In this condition, the individual elements are controlled in speed and position in matching relation to the change in the linear speed of the drum 25.

Another capability achievable with the color copier 70 is combination copying, e.g., it is capable of copying in combination a color image and a monocolor image of a plurality of documents on the same paper sheet. Specifically, in a combination copy mode, a color image on a first document is produced first. At this instant, the paper sheet 52 is retained on the transfer drum 24 and, after the transfer of the color image, held stationary. This poisition of the paper sheet 52 which is halted is stored in a central processing unit (CPU) of the copier 70, so that in the event of the transfer of a monocolor image the leading edge of the image and the paper sheet are synchronized to each other for producing a combined copy. Of course, such a combination of images is only illustrative and may be replaced with any other desired one. Further, positions of images to be combined on the same paper sheet may be specified by entering position data on an operation board and driving the transfer drum 24 in a particular range specified.

While the motors M1 and M2, FIG. 3, are operatively connected to, respectively, the photoconductive drum 25 and the transfer drum 24, an independent motor is operatively connected to the optics 74. The motor associated with the optics 70 is reversible in order to implement the reciprocating motion of the optics 70. A scanning sensor is provided for sensing the position (home position) of the lamp 76 and other elements of the optics 74 before the start of a scanning stroke, i.e., the scanning start position of the optics 74 are represented by a solid line in the figure. A paper sheet sensor is located in the vicinity of the transfer drum 24 to sense the trailing edge of the paper sheet 52 which is loaded on the transfer drum 24. A control system includes a reference pulse generator for generating reference pulses which are adapted to drive the motor M2 at a predetermined speed, servo circuits for individually controlling the speed of the motor M1 and that of the scanning motor, and a circuit for delivering a paper size indication to the servo circuits.

In the above construction, the transfer start timing and the transfer end timing are detected on the basis of an output signal of the scanning sensor and that of the paper sheet sensor. The rotation speed of the transfer drum 24 is controlled during the interval between the transfer end timing and the transfer start timing detected, so that the leading end of the paper sheet 52 on the transfer drum 24 and that of any of the toner images on the photoconductive drum 25 may coincide with each other. Specifically, it is not that the scanning, or exposure, begins at the same position for all the images of different colors by awaiting the end of one full rotation of the photoconductive drum 25 each time, but that immediately after a return stroke of the optics 74 the next scanning begins to expose the drum 25 imagewise. As a result, the scanning stroke is reduced with the paper size. In this instance, the rotation speed of the transfer drum 24 is controlled independently of that of the photoconductive drum 25 in order to eliminate the failure of register during image transfer.

In summary, it will be seen that the present invention provides a color image forming apparatus which insures reliable transport of a paper sheet during image transfer while preventing toner images from being blurred or from being dislocated relative to each other.

Various modifications will become possible for those skilled in the art after receiving the teachings of the present disclosure without departing from the scope thereof. For example, the present invention is applicable not only to a color copier of the type having a stationary glass platen and movable optics but also to a color copier of the type having a movable glass platen and stationary optics.

What is claimed is:

1. An image forming apparatus comprising:

photoconductive means for forming an electrostatic latent image thereon;

transfer means for transferring in a predetermined transfer region a visible image which has been produced by developing said latent image to a paper sheet which is held on said transfer means;

separator means arranged along periphery of said transfer means for separating from said transfer means said paper sheet to which said visible image has been transferred; and drive means for independently driving said photoconductive means and said transfer means;

said separator means being spaced apart from said transfer region along the periphery of said transfer means by a distance which is shorter than a dimension of a paper sheet having the smallest size usable with said apparatus as measured in an intended direction of paper transport.

2. An image forming apparatus as claimed in claim 1, further comprising fixing means for fixing said visible image on said paper sheet which has been separated by said separator means.

3. An image forming apparatus as claimed in claim 2, wherein said fixing means is spaced apart from said separator means by a distance which is longer than a dimension of a paper sheet having the largest size usable with said apparatus as measured in said intended direction of paper transport.

4. An image forming apparatus as claimed in claim 1, wherein each of said photoconductive means and said transfer means comprises a drum.

5. An image forming apparatus as claimed in claim 1, wherein each of said photoconductive means and said transfer means comprises a belt.

6. An image forming apparatus as claimed in claim 1, wherein said drive means comprises a motor for driving said photoconductive means and a motor for driving said transfer means.

7. An image forming apparatus as claimed in claim 1, wherein said separator means comprises a plurality of separator pawls.

8. An image forming apparatus as claimed in claim 2, wherein said fixing means comprises a pair of fixing rollers.

* * * * *